US006179043B1

(12) United States Patent
Betz

(10) Patent No.: US 6,179,043 B1
(45) Date of Patent: Jan. 30, 2001

(54) HEAVY VEHICLE RADIATOR WITH CENTER-MOUNTED HYDRAULIC COOLING FAN MOTOR AND HYDRAULIC MOTOR OIL COOLER

(75) Inventor: Michael D. Betz, Knoxville, IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/320,594

(22) Filed: May 27, 1999

(51) Int. Cl.[7] ..... F28F 3/02; F01P 7/10

(52) U.S. Cl. ..... 165/41; 165/51; 165/140; 165/67; 165/916; 165/122; 165/124; 123/41.49

(58) Field of Search ..... 123/41.49; 165/41, 165/51, 122, 140, 169, 124, 916

(56) References Cited

U.S. PATENT DOCUMENTS

| | | | | |
|---|---|---|---|---|
| 1,404,304 | * | 1/1922 | La Monte | 165/51 |
| 1,664,812 | | 4/1928 | Gargiulo et al. . | |
| 1,668,491 | | 5/1928 | Caesar . | |
| 1,858,839 | * | 5/1932 | Modine | 165/122 |
| 1,902,572 | * | 3/1933 | Modine | 165/124 |
| 1,992,130 | * | 2/1935 | Rose | 165/67 |
| 2,018,900 | * | 10/1935 | Rose | 165/67 |
| 2,037,857 | * | 4/1936 | Fox | 165/124 |
| 2,111,534 | * | 3/1938 | Karmazin | 165/166 |
| 2,124,523 | * | 7/1938 | Blanton | 165/140 |
| 2,184,837 | * | 12/1939 | Hemming | 165/124 |
| 2,378,351 | * | 6/1945 | Young | 165/122 |
| 2,461,409 | | 2/1949 | Christensen . | |
| 2,505,790 | * | 5/1950 | Panthofer | 165/140 |
| 2,600,933 | * | 6/1952 | Spieth | 165/122 |
| 3,751,191 | * | 8/1973 | Mott, Jr. et al. | 165/122 |
| 3,868,992 | * | 3/1975 | Getz et al. | 165/122 |
| 3,921,603 | | 11/1975 | Bentz et al. | 123/41.33 |
| 3,939,901 | * | 2/1976 | Cieszko et al. | 165/176 |
| 3,977,467 | | 8/1976 | Northrup, Jr. | 165/65 |
| 3,978,919 | * | 9/1976 | Fachbach et al. | 165/135 |
| 3,996,999 | | 12/1976 | Termont et al. | 165/41 |
| 4,062,401 | | 12/1977 | Rudny et al. | 165/125 |
| 4,072,187 | | 2/1978 | Lodge | 165/48 |
| 4,180,130 | * | 12/1979 | Beck et al. | 165/140 |
| 4,287,961 | | 9/1981 | Steiger | 180/68 R |
| 4,296,805 | | 10/1981 | Fleury | 165/151 |
| 4,377,203 | | 3/1983 | Ejima | 165/125 |
| 4,510,991 | | 4/1985 | Kawahira | 165/41 |
| 4,646,817 | | 3/1987 | Van Ee | 165/76 |
| 4,757,858 | * | 7/1988 | Miller et al. | 165/124 |
| 4,909,311 | * | 3/1990 | Nakamura et al. | 165/51 |
| 4,923,001 | | 5/1990 | Marcolin | 165/140 |
| 5,002,019 | * | 3/1991 | Klaucke et al. | 165/51 |
| 5,097,891 | * | 3/1992 | Christensen | 165/51 |
| 5,137,080 | * | 8/1992 | Haasch et al. | 165/78 |
| 5,499,674 | | 3/1996 | Bartz et al. | 165/76 |
| 5,850,872 | * | 12/1998 | Cesaroni | 165/140 |
| 5,901,786 | * | 5/1999 | Patel et al. | 165/51 |

FOREIGN PATENT DOCUMENTS

| | | | | |
|---|---|---|---|---|
| 2716997 | * | 10/1977 | (DE) | 123/41.49 |
| 0183596 | * | 6/1986 | (EP) | 123/41.49 |
| 255331 | * | 7/1926 | (GB) | 165/140 |
| 564692 | * | 10/1944 | (GB) | 165/140 |
| 0198311 | * | 12/1982 | (JP) | 123/41.49 |

* cited by examiner

*Primary Examiner*—John K. Ford
(74) *Attorney, Agent, or Firm*—John L. Rogitz

(57) ABSTRACT

An engine cooling system includes a two-pass radiator having multiple cores and a hydraulically-operated motor located between the cores. The motor drives a cooling fan that blows air against the radiator. Also, oil coolers are located between the cores to cool oil that is used to actuate the motor. With this structure, the space in the axial dimension that is consumed by the radiator with fan and fan motor is minimized.

12 Claims, 1 Drawing Sheet

Fig. 1
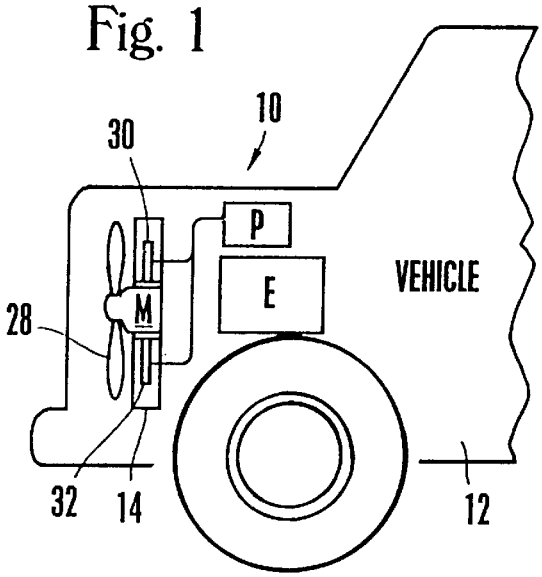
Fig. 2
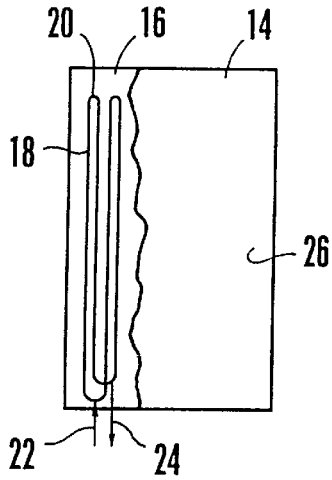
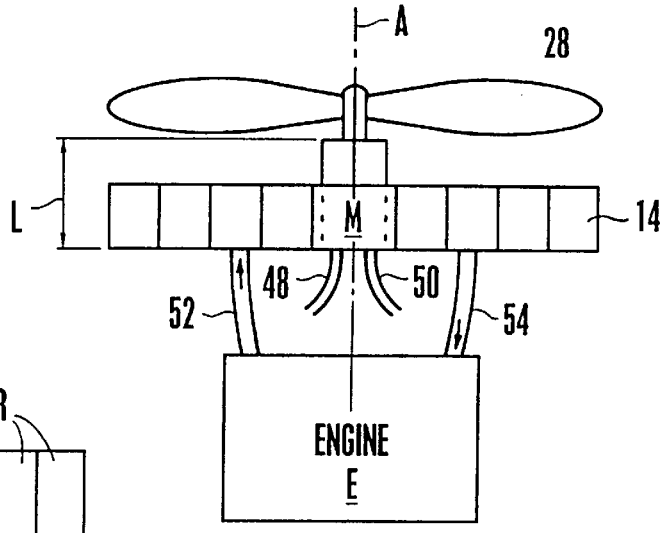
Fig. 4
Fig. 3
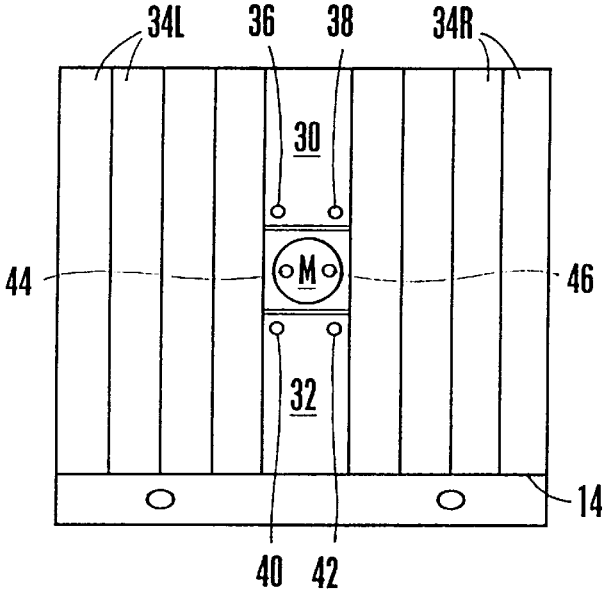

HEAVY VEHICLE RADIATOR WITH CENTER-MOUNTED HYDRAULIC COOLING FAN MOTOR AND HYDRAULIC MOTOR OIL COOLER

TECHNICAL FIELD

The present invention relates generally to engine cooling systems, and more particularly to heavy vehicle engine cooling systems.

BACKGROUND ART

The operation of heavy mechanical equipment such as large tractors generates considerable heat in the engines of the equipment, which must be efficiently dissipated to prevent damage to the engine. This is generally accomplished by coolant-based radiator systems, in which a pump circulates coolant through tubes in a radiator. Air cools the tubes and, hence, the coolant is then pumped through various engine components, e.g., an engine oil cooler, to cool these components.

The air that cools the tubes is blown past the tubes by a cooling fan located either just in front of or just behind the radiator. The cooling fan in turn is rotated by a motor which, as understood herein, can be a hydraulic motor that is actuated by oil which has been pressurized by a hydraulic pump.

Regardless of the particular type of motor used, however, the present invention understands that space inside an engine compartment of a heavy vehicle is limited, particularly in the axial (fore-and-aft) dimension. To reduce the amount of space required in the axial dimension by a cooling system, many existing systems minimize the size of the motor that rotates the fan. Unfortunately, minimizing the size, at least in the axial dimension, of the cooling fan motor can result in sacrificing power and/or efficiency. In either case, the cooling capacity and reliability of the system can be reduced. Fortunately, the present invention recognizes that it is possible to provide a cooling fan of adequate size and power, while minimizing the space in the axial dimension required by the cooling system

DISCLOSURE OF THE INVENTION

A cooling system for an engine defining an axial dimension and a lateral dimension includes a radiator having at least two modules, with each module including generally linear coolant tubes that are engageable with the engine in communication therewith for cooling the engine. A cooling fan is arranged for directing air against the coolant tubes. In accordance with the present invention, a hydraulically operated motor is disposed laterally between the modules and is coupled to the cooling fan to rotate the fan. With this structure, the combined length of the radiator, motor, and fan in the axial dimension is minimized.

In a preferred embodiment, the radiator defines a central axial axis, and the motor is mounted on the axis. Desirably, at least one hydraulic oil cooler is disposed laterally between the modules above or below the motor, and the oil cooler communicates with the motor to cool the oil that actuates the motor. In a particularly preferred embodiment, upper and lower oil coolers are disposed laterally between the modules above and below the motor, respectively. The system is disclosed in combination with the engine and in further combination with a vehicle such as a tractor.

In another aspect, an engine cooling system includes at least one radiator having one or more cores. The radiator is engageable with an engine of a vehicle to communicate coolant to the engine. At least one cooling fan motor is located at least partially collaterally with the radiator, and a cooling fan is coupled to the motor to direct air against the cores to cool coolant therein.

In still another aspect, a method for cooling an engine includes pumping coolant through a radiator to the engine, and rotating a fan by means of a motor at least partially collaterally located relative to the radiator. The method also includes blowing air against the radiator with the fan.

The details of the present invention, both as to its structure and operation, can best be understood in reference to the accompanying drawings, in which like reference numerals refer to like parts.

BRIEF DESCRIPTION OF THE DRAWINGS

FIG. 1 is a schematic side view of a vehicle such as a tractor that incorporates the present cooling system, with portions of the vehicle cut away for clarity;

FIG. 2 is a schematic cut away view of the present two-pass radiator with linear vertical coolant tubes;

FIG. 3 is a rear elevational view of the radiator with cooling fan motor and oil coolers; and FIG. 4 is a top plan view of the radiator, showing portions of the motor that are collateral with the radiator in phantom.

BEST MODE FOR CARRYING OUT THE INVENTION

Referring now to FIG. 1, a cooling system is shown, generally designated 10, for cooling an engine "E" of a vehicle, generally designated 12. The system 10 includes a primary radiator 14 having tubes through which coolant flows, with the outside surfaces of the tubes being exposed to air to cool the coolant in the tubes.

Referring briefly to FIG. 2, the radiator 14 is a non-spirally wound two-pass radiator that can have multiple cores or cooling modules 16 (only one core or cooling module 16 shown in FIG. 2). The cores or modules 16 are laterally side-by-side relative to the vehicle 12. Each core has elongated U-shaped (i.e., in-line), vertically-oriented tubes 18 that have respective U-shaped bights 20 to render the radiator 14 a two-pass radiator. Thus, each tube 18 has an inlet communicating with a coolant inlet header represented by the arrow 22 and an outlet communicating with a coolant outlet header represented by the arrow 24. The tubes 18 of the radiator 14 are parallel to the front surface 26 of the radiator 14.

In a particularly preferred embodiment, the primary radiator 14 is a radiator marketed by the present assignee under the trademark "AMOCS". By "two-pass" is meant that coolant flowing through each tube 18 passes twice across an air-cooled fin that is disposed in the bight 20 of the tube 18 in accordance with radiator principles.

Referring back to FIG. 1, a cooling fan 28 draws air against the radiator 14. The fan 28 is driven, i.e., is caused to rotate, by a motor "M". Preferably, the motor "M" is a hydraulically-actuated motor. To this end, upper and lower oil coolers 30, 32 are collaterally mounted in the radiator 14 as more fully disclosed below to cool pressurized oil from an oil pump "P"and direct the cooled, pressurized oil to the motor "M".

Now referring to FIGS. 3 and 4, the details of the system 10 can be seen. As shown in FIG. 3, the radiator 14 is oriented vertically, and, in the particular embodiment illustrated, consists of four rectangular cooling modules 34L on the left side of the radiator, and four similar modules 34R on the right side of the radiator, although greater or fewer modules can be used. As shown, the two groups of modules are separated from each other by the upper hydraulic cooler 30, the cooling fan motor "M", and the lower hydraulic oil cooler 32. In the particular embodiment illustrated, the cooling fan motor "M" is situated beneath the upper hydraulic oil cooler 30, and the lower hydraulic oil cooler 32 is situated beneath the cooling fan motor "M". The rear portion of cooling fan motor "M" may be seen in the center of FIG. 3.

In any case, FIG. 3 shows that oil inlet and outlet ports 36, 38 are provided in the upper oil cooler 30. Likewise, oil inlet and outlet ports 40, 42 are provided in the lower oil cooler 32. Moreover, oil inlet and outlet ports 44, 46 are provided in the motor "M", and the ports 44, 46 communicate with respective oil inlet and outlet tubes 48, 50.

Importantly, as shown best in FIG. 4, at least a portion of the motor "M" is enclosed in the radiator 14. Stated differently, the cooling fan motor "M" is located at least partially collaterally, relative to the axial dimension "A" of the engine "E", with the radiator 14, to minimize the combined length "L" of the radiator 14 and motor "M".

As also shown in FIG. 4, engine coolant passes out of the engine 12 through an engine coolant return line 52 and into the radiator 14, where it circulates through one or more of the cooling modules 34L, 34R. The coolant then exits the radiator 14 and returns to the engine through an engine coolant supply line 54.

INDUSTRIAL APPLICABILITY

With the above disclosure in mind, it will readily be appreciated that the present invention makes possible a significant reduction in the size of engine compartments of heavy machinery, especially in the axial dimension where space is at a particular premium.

In operation of the system 10, the hydraulically-actuated cooling fan motor "M" drives the cooling fan 28, which cools the radiator 14 by blowing air against the radiator fins, and which also cools the upper and lower hydraulic oil coolers 30 and 32. The heat generated by the motor "M" is extracted as the hydraulic oil flows from the outlet port 46 of the motor "M" via the outlet tube 50, through the pump "P" (FIG. 1), and into the coolers 30, 32. The oil can flow into the inlet ports 36, 40 of the oil coolers 30, 32 and out of the outlet ports 38, 42 of the coolers 30, 32 (i.e., the coolers 30, 32 can be arranged in parallel with each other), and thence to the inlet port 44 of the motor "M" via the tube 48. Alternatively, the oil can flow into the inlet port 36, 40 of one of the oil coolers 30, 32 and out of the respective outlet port 38, 42 of the cooler 30, 32, then flow through the other cooler 32, 30 before returning to the motor "M" (i.e., the coolers 30, 32 can be arranged in series with each other). In either case, the pump "P" can be on either the inlet or outlet sides of the coolers 30, 32.

While the particular HEAVY VEHICLE RADIATOR WITH CENTER-MOUNTED HYDRAULIC COOLING FAN MOTOR AND HYDRAULIC MOTOR OIL COOLER as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". Other aspects and advantages of this invention can be obtained from a study of the drawing, the disclosure, and the appended claims.

What is claimed is:

1. A cooling system for an engine defining an axial dimension and a lateral dimension, comprising:

the engine;

a radiator having at least two modules, each module including generally linear coolant tubes engageable with the engine in communication therewith for cooling the engine;

one and only one cooling fan rotating about a horizontal axis and arranged for directing air against the coolant tubes;

a hydraulically operated motor disposed laterally between the modules and coupled to the cooling fan to rotate the fan, wherein the combined length of the radiator, motor, and fan in the axial dimension is minimized; and at least one hydraulic oil cooler disposed laterally between the modules above or below the motor, the oil cooler communicating with the motor.

2. The system of claim 1, wherein the radiator defines a central axial horizontal axis about which the fan rotates, and the motor is mounted on the axis.

3. The system of claim 1, comprising at least upper and lower oil coolers disposed laterally between the modules above and below the motor, respectively.

4. The combination of claim 1, in further combination with a vehicle.

5. An engine cooling system, comprising:

at least one radiator having at least two cores, the radiator being engageable with an engine of a vehicle to communicate coolant to the engine;

one and only one cooling fan motor located in the same plane with the radiator;

a cooling fan coupled to the motor for rotation about a horizontal longitudinal axis to direct air against the cores to cool coolant therein; and at least one hydraulic oil cooler disposed laterally between the cores above or below the motor, the oil cooler communicating with the motor, wherein each core includes generally linear coolant tubes engageable with the engine in communication therewith for cooling the engine, and wherein the motor is a hydraulically operated motor disposed laterally between the cores and coupled to the cooling fan to rotate the fan.

6. The system of claim 5, wherein the radiator defines a central axial axis, and the motor is mounted on the axis.

7. The system of claim 5, comprising at least upper and lower oil coolers disposed laterally between the cores above and below the motor, respectively.

8. The system of claim 5, in combination with the engine, the cores communicating coolant to the engine.

9. The combination of claim 8, in further combination with a vehicle.

10. The system of claim 5, wherein the radiator is a two-pass radiator.

11. A method for cooling an engine defining an axial dimension, comprising:

pumping coolant through a multi-module radiator to the engine, the radiator being oriented upright to a transverse plane to the engine, the transverse plane being perpendicular to the axial dimension;

rotating about a horizontal axis one and only one fan by means of a motor located in the transverse plane;

blowing air against the radiator with the fan;

disposing at least one oil cooler between modules of the radiator; and directing oil from the oil cooler to the motor.

12. The method of claim 11, wherein the radiator is a two-pass radiator and the motor is a hydraulically-operated motor.

* * * * *

UNITED STATES PATENT AND TRADEMARK OFFICE

CERTIFICATE OF CORRECTION

PATENT NO. : 6,179,043 B1
DATED : January 30, 2001
INVENTOR(S) : Michael D. Betz It is certified that error appears in the above-identified patent and that said Letters Patent is hereby corrected as shown below:

Column 5,
Line 4, delete "to" and insert -- in --

Signed and Sealed this

Fifth Day of February, 2002

*Attest:*

*Attesting Officer*

JAMES E. ROGAN
*Director of the United States Patent and Trademark Office*